US006402535B2

(12) United States Patent
Okabe et al.

(10) Patent No.: US 6,402,535 B2
(45) Date of Patent: Jun. 11, 2002

(54) CONNECTOR SUPPORTING STRUCTURE

(75) Inventors: Toshiaki Okabe; Shinobu Kayama, both of Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/906,710

(22) Filed: Jul. 18, 2001

(30) Foreign Application Priority Data

Jul. 25, 2000 (JP) ..... 2000-223811

(51) Int. Cl.[7] ..... H01R 13/62
(52) U.S. Cl. ..... 439/157
(58) Field of Search ..... 439/157, 372, 439/310, 152, 155

(56) References Cited

U.S. PATENT DOCUMENTS 5,401,179 A * 3/1995 Shinchi et al. ..... 439/157

* cited by examiner

*Primary Examiner*—Brian Sircus
*Assistant Examiner*—Javaid Nasri
(74) *Attorney, Agent, or Firm*—Finnegan, Henderson, Farabow, Garrett & Dunner, L.L.P.

(57) ABSTRACT

A connector supporting structure includes a female connector 4 temporarily engaged in a bracket 3 fixed to an instrumental panel 1 and a male connector 5 where a cam lever 27 is rotatably supported by a male connector housing 26. Since a rotation handling part 39 of the cam lever 27 butts against a step part 16A of the bracket 3 to receive a reaction force, the cam lever 27 is rotated to effect the engagement between the connectors 4, 5. On the lateral side of the front end of a male connector housing 26, protective cover parts 26B are formed so as to extend sideways. Before fitting the connector 4 to the connector 5, the protective cover parts 26B operate to protect the rotation handling part 39. When fitting the connector 4 to the connector 5, the protective cover parts 26B come into contact with a guide slant face 15*a* formed on the bracket 3, so that the cam lever 27 can be prevented from being broken.

9 Claims, 18 Drawing Sheets

CONNECTOR SUPPORTING STRUCTURE

BACKGROUND OF THE INVENTION

The present invention relates to a connector supporting structure. More particularly, it relates to a connector supporting structure by which a pair of male and female connectors are engaged with each other and fixed on a connector carrier.

Conventionally, this kind of connector supporting structure includes a connector previously attached to an instrumental panel etc. and another connector to be engaged with the connector by artificial manipulation. Note, in the following descriptions, the former connector on the instrumental panel will be referred as "Immovable connector", while the latter connector will be referred as "movable connector". In this structure, the immovable connector is generally provided with a pair guide projections. Correspondingly, the movable connector has a pair of cam levers rotatably attached to a main body of the movable connector. The cam levers have respective cam grooves formed for engagement with the guide projections of the immovable connector. Each cam groove of the movable connector is provided with an inlet for accepting the guide projection of the immovable connector. In process of connecting the movable connector with the immovable connector, since respective leading ends of the cam levers butt against the panel, the cam levers are rotated due to reaction force from the panel. During this rotation of the cam levers, the guide projections of the immovable connector are respectively guided in the guide grooves of the movable connector, so that the movable connector is finally fitted to the immovable connector for integration.

In the above-mentioned conventional structure, however, the cam levers of the movable connector are easy to interfere with obstacles etc. in the handling or transporting stage of the movable connector before fitting to the immovable connector, due to their projecting form from the main body. According to circumferences, it is feared that the cam levers are damaged or broken due to the interference with the obstacles or the like.

SUMMARY OF THE INVENTION

Under the circumstances, it is therefore an object of the present invention to provide a connector supporting structure which is capable of preventing a cam lever from being damaged thereby to allow the lever to butt against a mounting object, such as panel, certainly.

The object of the present invention described above can be accomplished by a connector supporting structure comprising:

an attachment member;

a first connector to be temporarily engaged with the attachment member, the first connector having a first connector housing on which at least one guide projection is formed; and a second connector for engagement with the first connector, the second connector having a second connector housing; and at least one cam lever rotatably supported on the second connector housing, the cam lever having a cam groove formed therein to guide the guide projection of the first connector and a rotating handling part formed for abutment against the attachment member; wherein the second connector housing has at least one protective cover part formed on one side of the front end of the second connector housing, the front end facing the first connector in arrangement; and the cam lever is supported on the second connector housing in a manner that the rotating handling part occupies its position behind the protective covering part when the cam lever is arranged in its initial position against the second connector housing in advance of the engagement of the second connector with the first connector;

whereby the approach of the second connector toward the first connector allows the rotating handling part of the cam lever to abut against the attachment member and also causes the cam lever to be rotated thereby to engage the first connector with the second connector.

In the above-mentioned structure, the first connector is engaged with the second connector by the cam lever's rotation while the guide projection is being inserted into the cam groove of the cam lever. When the cam lever is in the initial position, the rotating handling part of the cam lever occupies the position behind the protective covering part of the second connector housing facing the attachment member. Therefore, since the rotating handling part is protected from its outside by the protective covering part, it is possible to prevent the rotating handling part from being damaged by obstacles etc. Thus, it is possible to prevent the cam lever from being broken, also preventing the inappropriate engagement between the first connector and the second connector.

As the second aspect of the invention, in the above connector supporting structure, the attachment member comprises a cylindrical bracket which is fixed on an opening of a plate member to have a cylindrical port communicating with the opening of the plate member, the bracket being adapted so as to have the first connector temporarily engaged therein and also having a guide part formed on an inner face of the bracket to guide the protective cover part to an innermost part of the bracket.

Owing to the provision of the guide part, the positioning of the second connector to the first connector can be easily effected by the movement of the second connector approaching the first connector in a direction to engage the former connector with the latter connector. That is, according to the invention, the fitting operation between the first and second connectors can be accomplished easily and certainly.

As the third aspect of the invention, in the above connector supporting structure, the bracket has an engagement step part formed behind the guide part in a direction to engage the first connector with the second connector, for engagement with the rotating handling part.

Owing to the provision of the engagement step part, the rotating handling part, which has been guided into the innermost part of the bracket by the guide part, is engaged with the engagement step part. Therefore, when the second connector is further moved in the direction to engage the first connector with the second connector, the cam lever having the rotating handling part under the immovable condition is rotated with respect to the second connector housing, allowing the guide projection in the cam groove to be moved. In this way, the engagement (fitting) operation of the first and second connectors can be progressed.

As the fourth aspect of the invention, in the above connector supporting structure, the guide part is in the form of a projection having a slant face inclined to the direction to engage the first connector with the second connector.

Owing to the provision of the slant face, when fitting the second connector to the first connector, the second connector housing is guided on the slant face smoothly. Thus, the positioning of the second connector to the first connector can be effected furthermore.

As the fifth aspect of the invention, in the above connector supporting structure, the cam lever is provided, in the vicinity of the rotating handling part, with a lever temporary-engagement piece which is engaged with the second connector housing, for temporarily engaging the cam lever in the initial position.

Then, in the previous stage before fitting the first connector to the second connector, the positioning of the cam lever in the above initial position can be ensured by the lever temporary-engagement piece engaging with the second connector housing.

As the sixth aspect of the invention, in the above connector supporting structure, the cam groove has at least one part formed so as to gradually approach a rotational center of the cam lever.

Owing to the above formation, the part of the cam groove operates to let the guide projection forcibly come near the rotational center of the cam lever by so-called "force-magnifying" effect. Thus, even if the force to press the second connector is small, it is possible to let the guide projection come near the rotational center certainly, developing the engagement between the first connector and the second connector furthermore.

As the seventh aspect of the invention, in the above connector supporting structure, it is established that a distance between the part of the cam groove and the rotational center is smaller than a distance between the rotating handling part and the rotational center of the cam lever.

Owing to the establishment of the above distances, when releasing the engagement between the first and second connectors, the guide projection is subjected to the "force-magnifying" effect and easily driven in a direction apart from the second connector in spite of the operator's small force to separate the first connector from the second connector.

As the eighth aspect of the invention, in the above connector supporting structure of the third aspect, the bracket has a temporary engagement piece formed for engagement with the guide projection of the first connector thereby to effect the temporarily engagement of the bracket with the first connector.

As the ninth aspect of the invention, in the above connector supporting structure, the temporarily engagement of the bracket with the first connector is released by the cam lever on the second connector when the second connector is engaged with the first connector.

These and other objects and features of the present invention will become more fully apparent from the following description and appended claims taken in conjunction with the accompany drawings.

DESCRIPTION OF THE PREFERRED EMBODIMENT

An embodiment of the present invention will be described with reference to the drawings.

Figure 1:
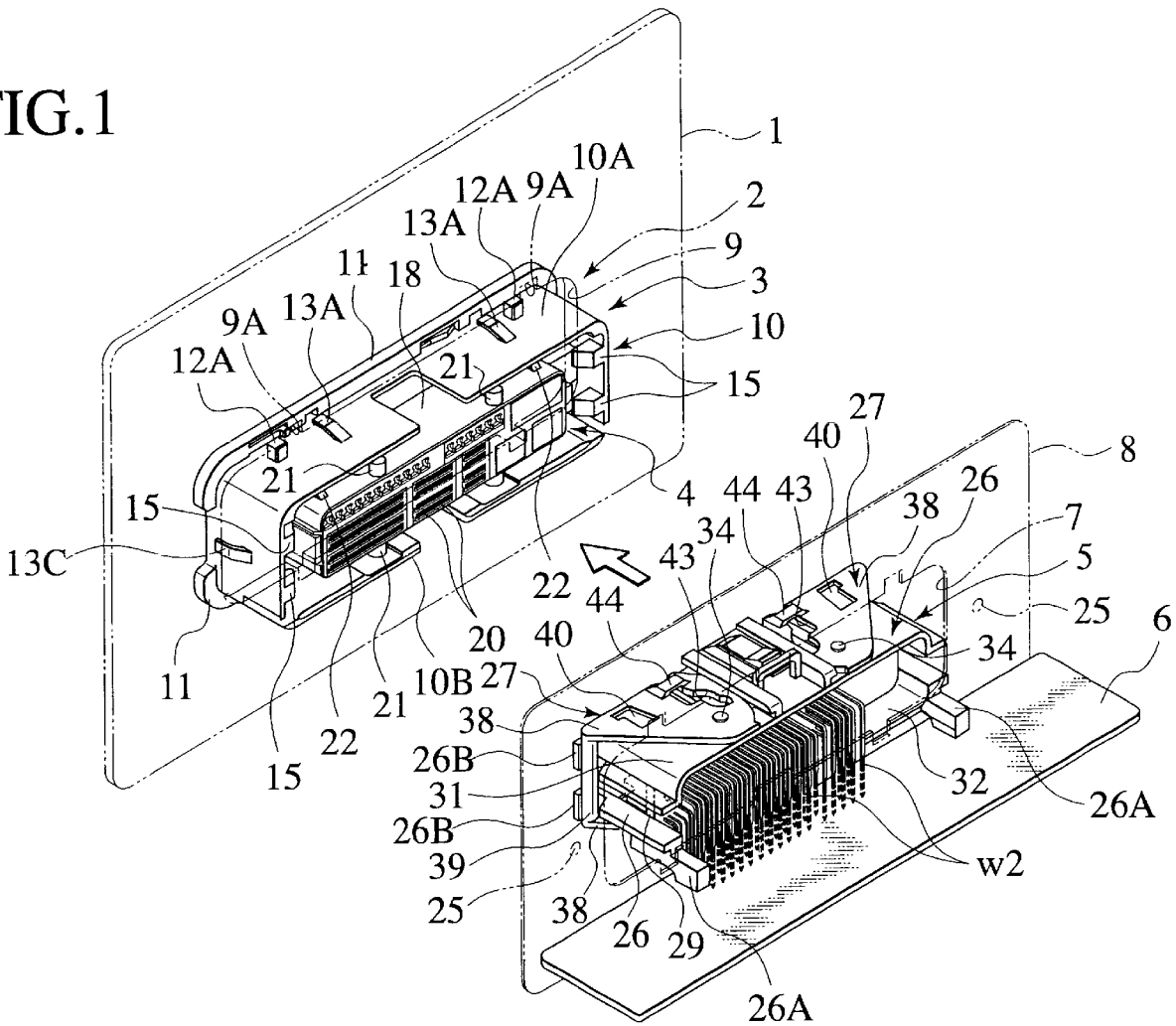
FIG. 1 is a perspective view of the connector supporting structure in accordance with an embodiment of the invention.

FIG. 1 is a perspective view of a connector supporting structure in accordance with the embodiment of the invention. As shown in this figure, the connector supporting structure of the embodiment generally comprises a mounted part 2 of an instrumental panel 1 arranged on the side of an automotive stay member, a bracket (attachment member) 3 attached to the mounted part 2, a female connector 4 engaged in the bracket 3, a male connector 5 joined to the female connector 4, an appliance's base plate 6 fixed to the male connector 5 and an escutcheon 8 standing on an edge of the base plate 6 and having a connector port 7 allowing the male connector 5 to project outside of the appliance.

Figure 2:
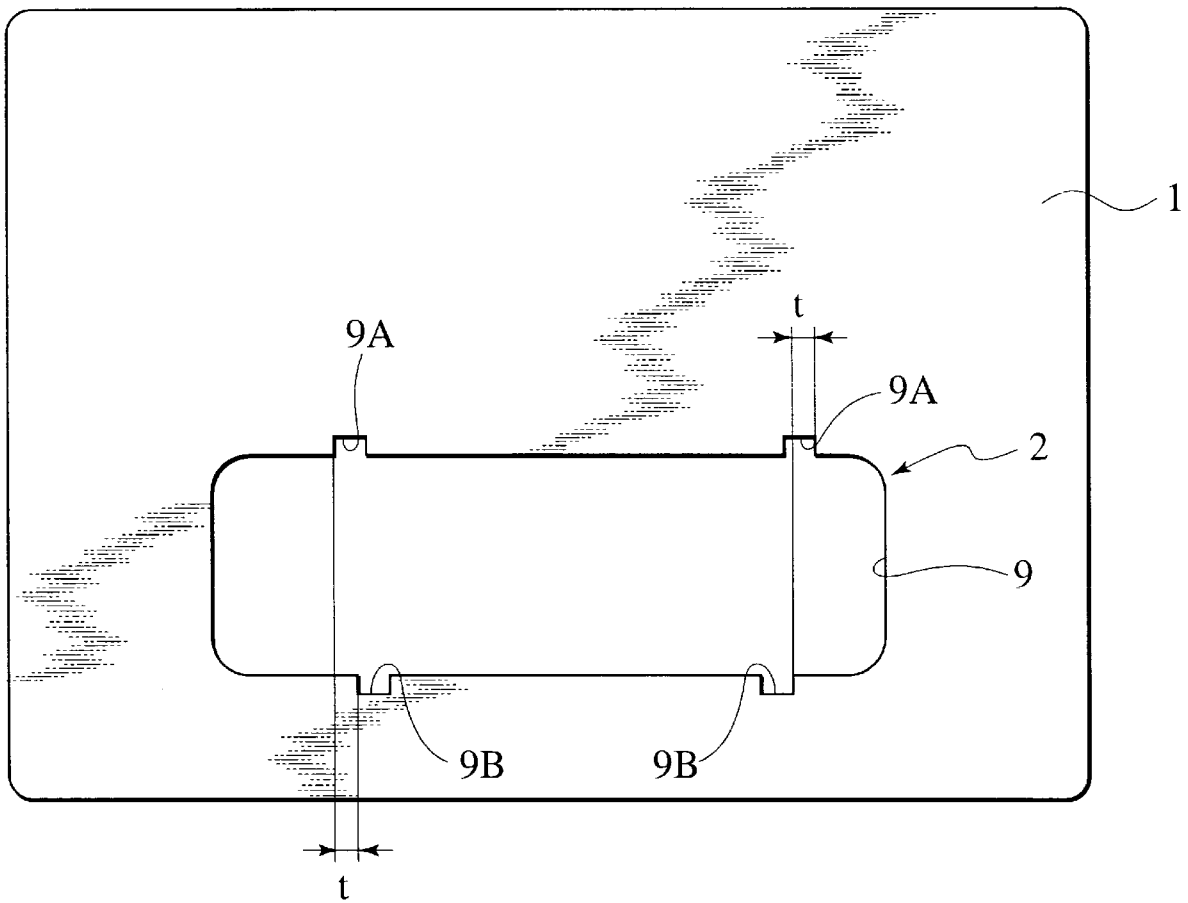
FIG. 2 is a front view of an instrumental panel used for the connector supporting structure of the embodiment, showing a bracket opening formed in the panel.

First, we now describe the structure of the mounted part 2 of the instrumental panel 1 with reference to FIG. 2.

The mounted part 2 is arranged on the bottom of a recess formed on the instrumental panel 1. The mounted part 2 has a bracket port 9 formed in the instrumental panel 1. The bracket port 9 has a pair of notches 9A, 9A formed on an upper edge of the port and a pair of notches 9B, 9B formed on a lower edge of the port. Note, the lower notches 9B, 9B are respectively positioned inside of the upper notches 9A, 9A by distances (t), to accomplish the appropriate positioning of the later-mentioned bracket 3 to be fitted to the port 9 (see FIG. 2).

Figure 3:
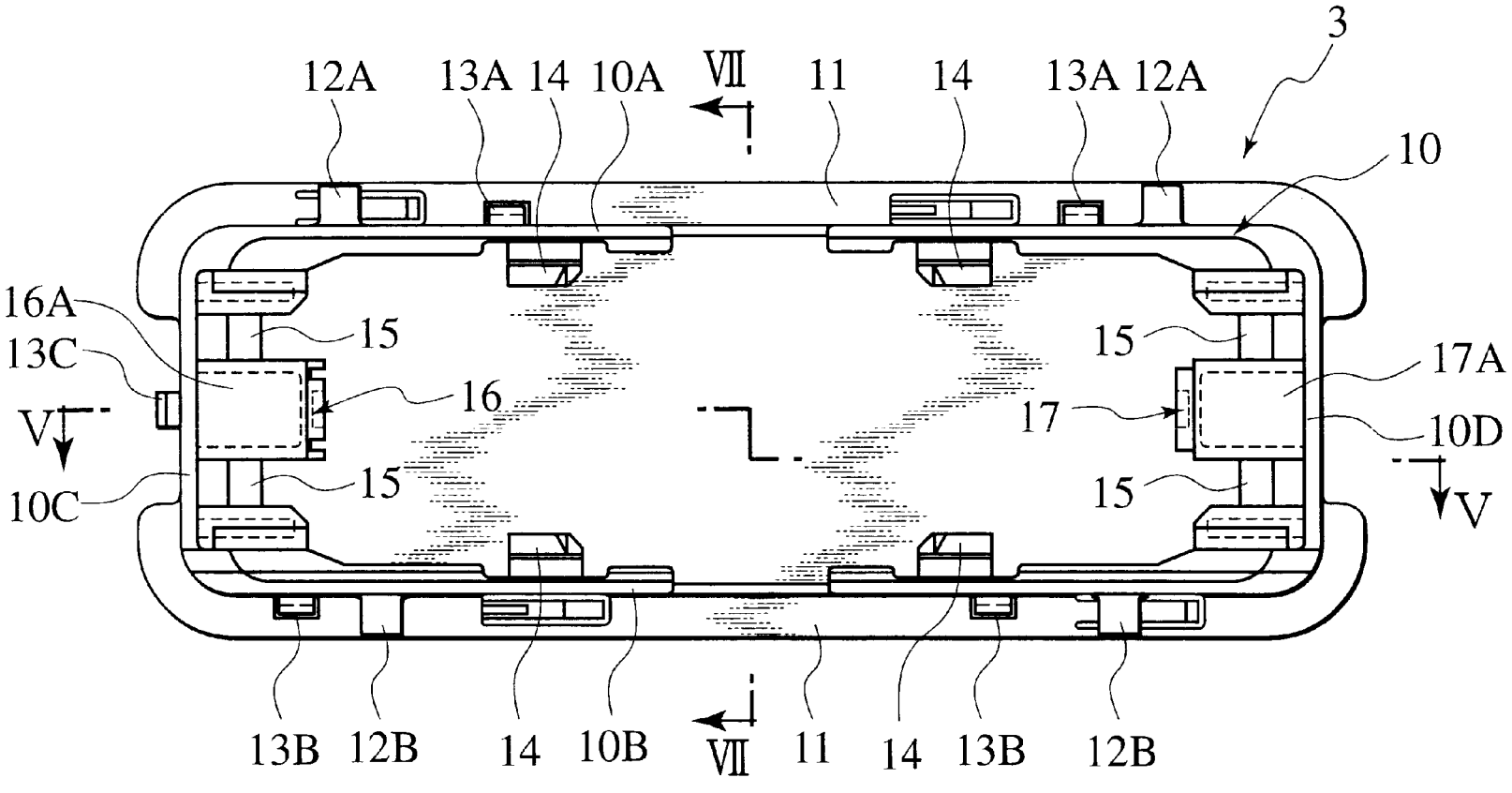
FIG. 3 is a plan view of a bracket forming the connector supporting structure of the embodiment of the invention.
Figure 4:
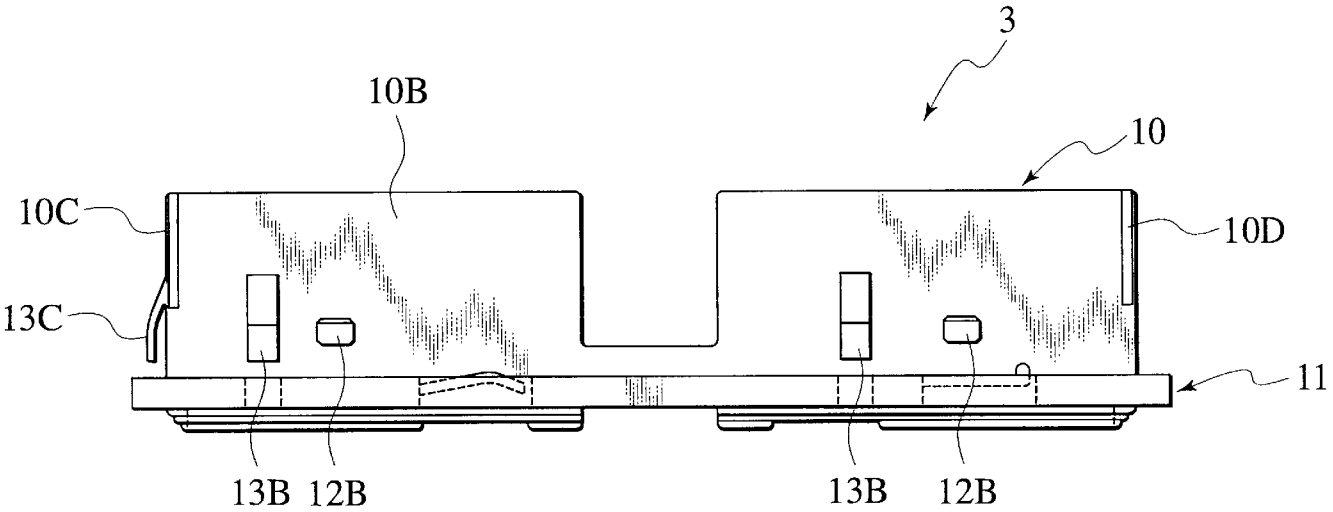
FIG. 4 is a front view of the bracket in the embodiment of the invention.
Figure 5:
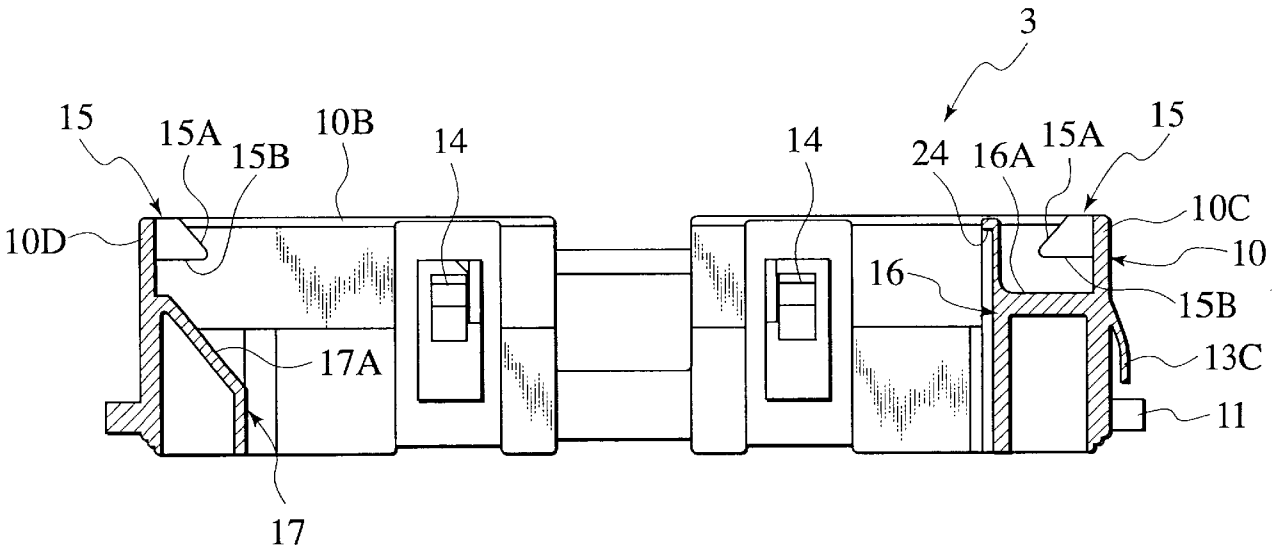
FIG. 5 is a cross-sectional view taken along line V—V of FIG. 3.
Figure 6:
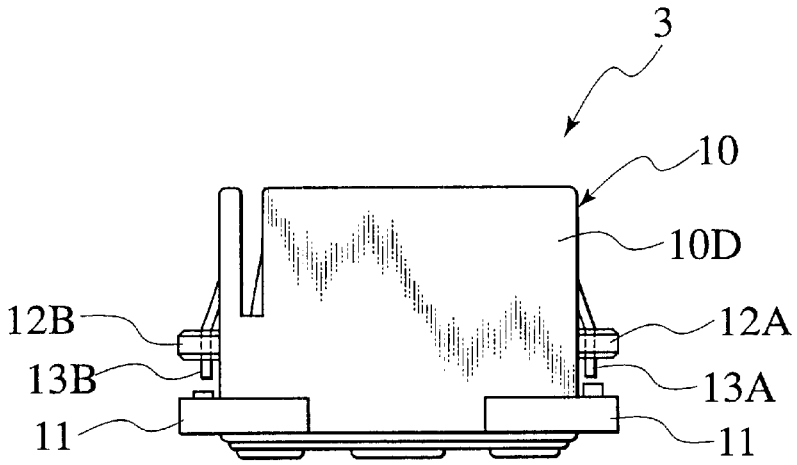
FIG. 6 is a side view of the bracket in the embodiment of the invention.
Figure 7:
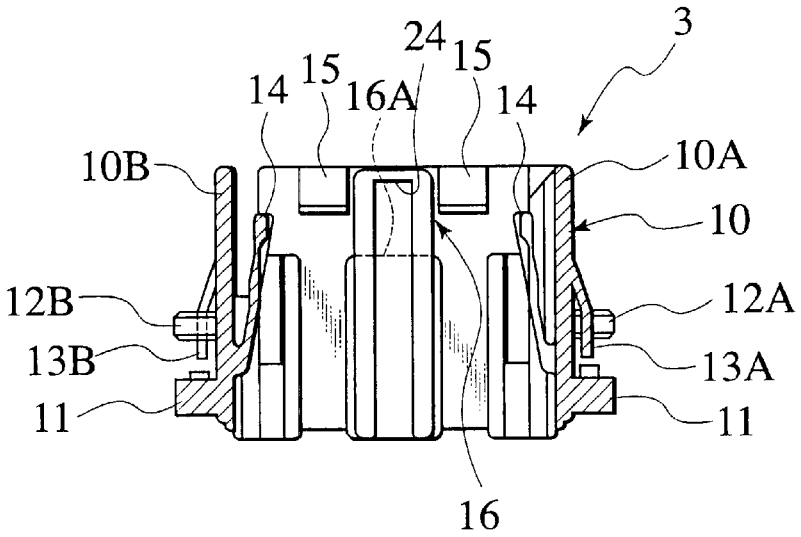
FIG. 7 is a cross-sectional view taken along line VII—VII of FIG. 3.

The structure of the bracket 3 will be described with reference to FIGS. 1, 3 to 7. In these figures, FIG. 3 is a plan view of the bracket 3, showing the front end of the bracket 3. FIG. 4 is a front view of the bracket 3; FIG. 5 a cross-sectional view taken along line V—V of FIG. 3; FIG. 6 a side view of the bracket 3, and FIG. 7 is a cross-sectional view taken along line VII—VII of FIG. 3.

The bracket 3 has a rectangular-shaped cylinder part 10 for temporary engagement with the connector, and upper and lower flange parts 11 formed along upper and lower edges of a base end of the cylinder part 10 so as to project laterally. Note, the flange parts 11 are formed so as to extend up to both sides of the base end of the bracket 3 (see FIG. 1).

The cylinder part 10 has a cross section somewhat smaller than a size of the bracket port 9, allowing the part 10 to pass through the rectangular port 9. When inserting the cylinder part 10 into the port 9, the flange parts 11 butt against the circumference of the port 9. Therefore, it is impossible for the bracket 3 to pass through the port 9. Repeatedly, the flange parts 11 are formed to project from the base end of the cylinder part 10 to the lateral side by predetermined lengths.

On the outside wall of an upper sidewall 10A of the cylinder part 10 and in the vicinity of the base end of the part 10, panel-carrier projections 12A, 12A are formed to project sideways, as shown in FIGS. 1 and 3. A distance between the projections 12A, 12A is established to be equal to a distance between the notches 9A, 9A of the upper edge of the port 9. Further, each projection 12A is established in size to allow it to pass through the notch 9A. Similarly, on the outside wall of a lower sidewall 10B of the cylinder part 10 and in the vicinity of the base end of the part 10, panel-carrier projections 12B, 12B are formed to project sideways, as shown in FIGS. 3 and 4. A distance between the projections 12B, 12B is established to be equal to a distance between the notches 9B, 9B of the lower edge of the port 9. Further, each projection 12B is established in size to allow it to pass through the notch 9B.

In the positional relationship, these projections 12A, 12A, 12B, 12B are adapted so as to pass through the notches 9A, 9A, 9B, 9B formed about the port 9 simultaneously. Thus, the panel-carrier projections 12B, 12B are positioned inside of the projections 12A, 12A by distances (t), respectively.

The upper sidewall 10A has a pair of engagement claws 13A, 13A formed inside the panel-carrier projections 12A, 12A, with elasticity. Each engagement claw 13A is inclined as if it were gradually standing toward the base end of the bracket 3. Similarly, the lower sidewall 10B has a pair of engagement claws 13B, 13B formed beside the panel-carrier projections 12B, 12B, with elasticity. Each engagement claw 13B is also inclined as if it were gradually standing toward the base end of the bracket 3. Additionally, in both sidewalls 10C, 10D interposed between the upper sidewall 10A and the lower sidewall 10B, the sidewall 10C has a similar elastic claw 13C formed as if it were gradually standing toward the base end of the bracket 3 (see FIGS. 1, 3 and 4).

The cylinder part 10 has a pair of temporary-engagement arms 14, 14 formed on the inside face of each sidewall 10A, 10B. On the inside wall of each sidewall 10A, 10B, each temporary-engagement arm 14 is formed so as to stand obliquely inward as approaching from the base end of the cylinder part 10 to the leading end. These temporary-engagement arms 14 are adapted so as to engage with the later-mentioned female connector 4 temporarily.

On the inside faces of the sidewalls 10C, 10D on both sides of the cylinder part 10, there are respectively formed, on the side of the leading end of the part 10, a pair of "lever-seceding" projections 15, 15 which direct inward as shown in FIGS. 3 and 5. On each sidewall 10C, 10D, the projections 15, 15 are separated from each other at a predetermined distance. At the intermediate position between the projections 15, 15 on the sidewall 10C and behind them (the side of the base end), a "lever-catching" projecting part 16 is formed toward the interior of the cylinder part 10 to catch later-mentioned cam levers 27 (see FIG. 18). While, at the intermediate position between the projections 15, 15 on the sidewall 10D and behind them, a guide projecting part 17 is formed toward the interior of the cylinder part 10, with a guide face 17A for guiding a later-mentioned male connector housing 26. In assembly, the male connector housing 26 is inserted into a space defined between the "ever-catching" projecting part 16 and the guide projecting part 17.

As shown in FIG. 5, each "lever-seceding" projection 15 has a slanted guide face 15A for guiding a protective cover part 26B formed on the male connector housing 26 and a "seceding-force" applying face 15B for engagement with a rotation handling part 39 at the seceding operation. The faces 15B of the projections 15, 15 are formed to be generally perpendicular to the inside faces of the sidewalls 10C, 10D.

Figure 8:
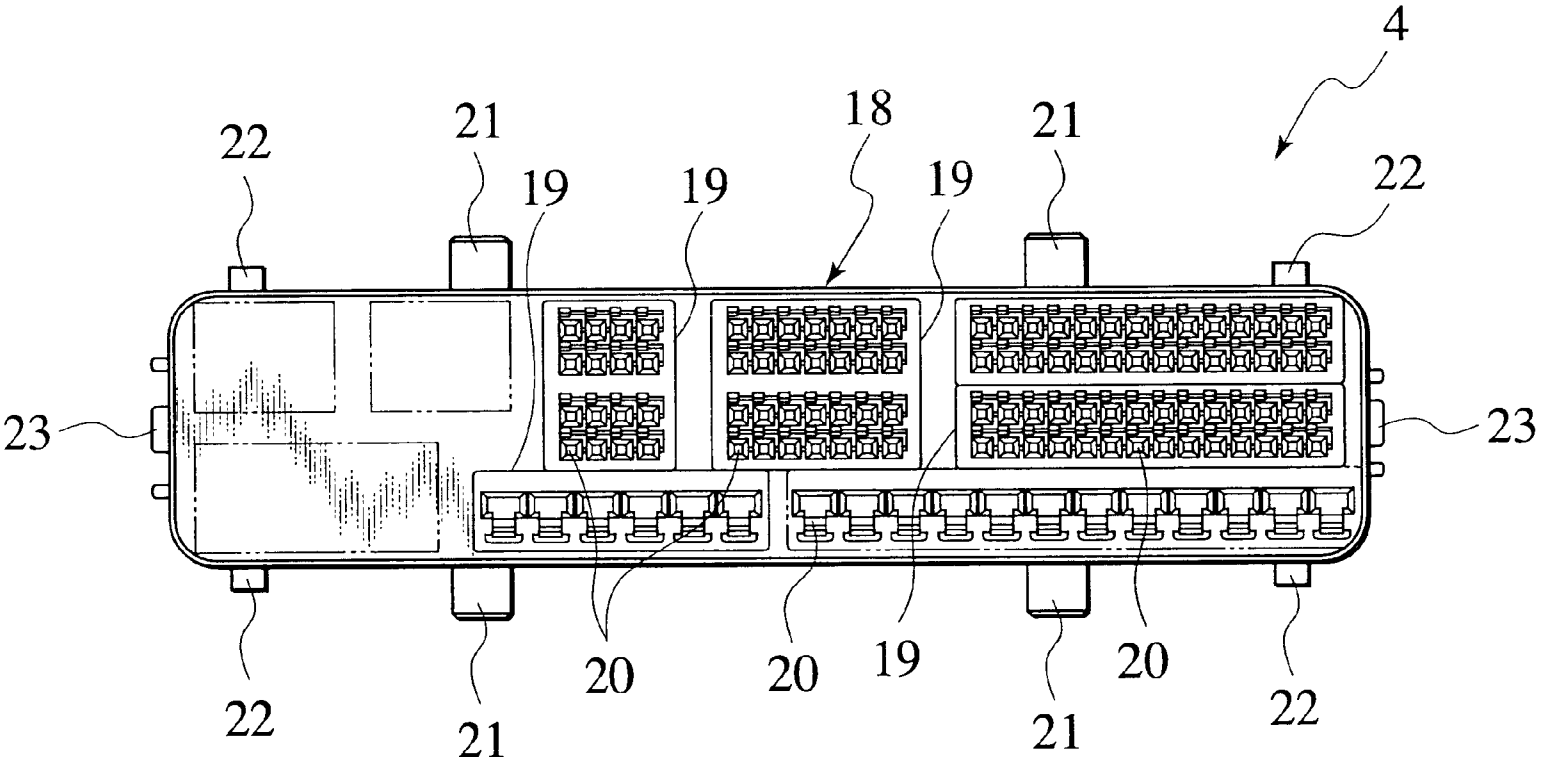
FIG. 8 is a plan view of a female connector housing forming the connector supporting structure of the embodiment of the invention.
Figure 9:
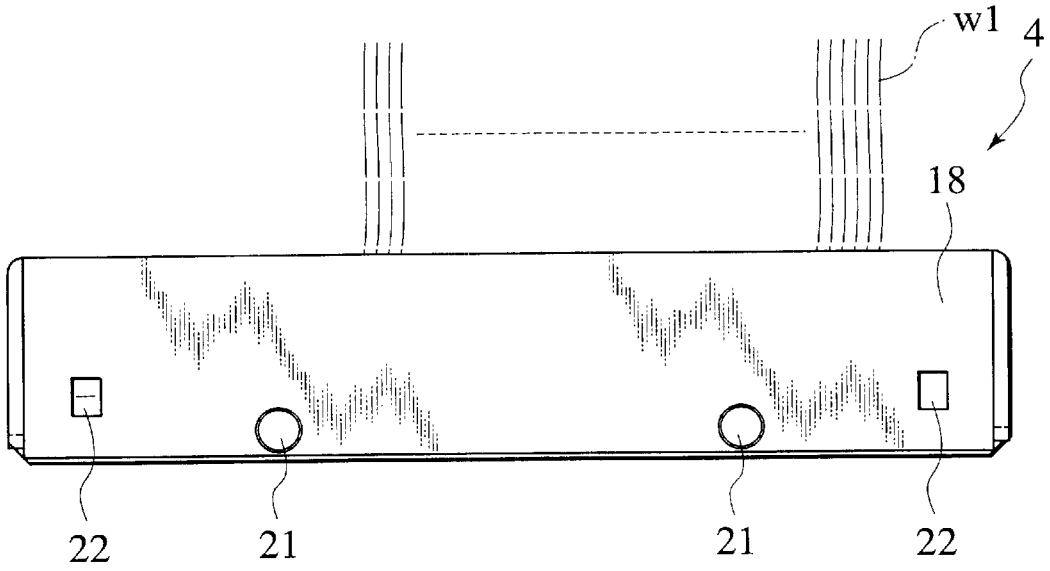
FIG. 9 is a front view of the female connector housing of the connector supporting structure of the embodiment.
Figure 10:
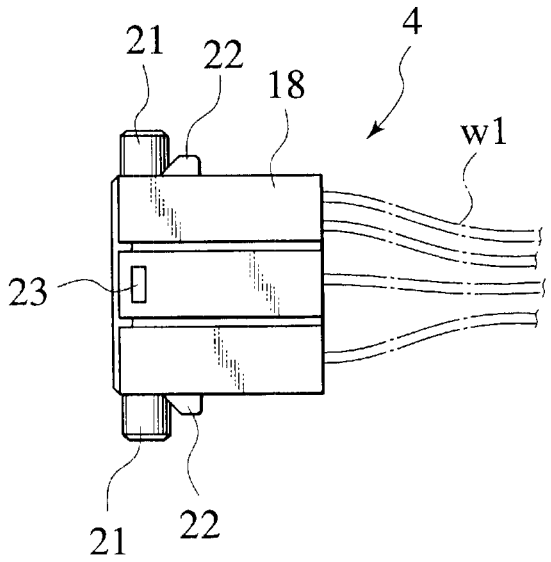
FIG. 10 is a side view of the female connector housing.

The constitution of the female connector 4 will be described with reference to FIG. 1 and FIGS. 8 to 10. FIG. 8 is a plan view of the front face of the female connector 4. FIG. 9 is a front view of the connector 4 and FIG. 10 is a side view thereof.

The female connector 4 generally includes a female connector housing 18, a plurality of blocks 19 formed in the housing 18 and each having a plurality of terminal accommodating chambers and a plurality of female terminals 20 accommodated in the terminal accommodating chambers of each block 19. As shown in FIG. 8, the terminals 20 have connecting ports positioned on the side of the front end of the female connector housing 18. Again, the terminals 20 have their rear ends connected to wires w1 respectively. These wires w1 are respectively withdrawn from the rear end of the female connector housing 18.

On the upper face of the female connector housing 18 and also in the vicinity of the front end of the housing 18, a pair of bosses 21, 21 are formed to project at a predetermined distance, as guided projections for engagement with guide grooves of the cam levers mentioned later. Similarly, the lower face of the female connector housing 18 is provided, in the vicinity of the front end, with the bosses 21, 21 in pairs. These bosses 21 are arranged in respective positions corresponding to the temporary-engagement arms 14, 14 on the inside face of the bracket 3 when the female connector 4 is inserted into the bracket 3. Further, the female connector housing 18 has spacers 22 formed on both sides of the upper and lower faces in the direction of width, for separating the housing 18 from the inner wall of the bracket 3 at a designated distance. As shown in FIGS. 8 and 10, on both side faces of the female connector housing 18 and also in the vicinity of the front end of the housing 18, a pair of stoppers 23, 23 are formed to define the terminus of the female connector 4 when it is inserted into the bracket 3. Correspondingly, the bracket 3 is provided with stopper receivers 24 which come into contact with the stoppers 23, 23 to define the terminus of the female connector 4 inserted.

Here, we describe the steps of attaching the bracket 3 to the mounted part 2 and the steps of engaging the female connector 4 with the bracket 3 temporarily, in brief.

First, the cylinder part 10 of the bracket 3 is inserted into the bracket port 9 of the instrumental panel 1 from its backside. Simultaneously, adjust the positions of the four panel-carrier projections 12A, 12A, 12B, 12B to the four notches 9A, 9A, 9B, 9B on the edge of the port 9, respectively. In process of inserting the cylinder part 10 into the bracket port 9, the flange part 11 of the bracket 3 butts against the opening edge of the bracket port 9. Subsequently, the bracket 3 is slid along the surface of the instrumental panel 1 in the horizontal direction. Thus, the projections 12A, 12B are deviated from the notches 9A, 9B in their positions, whereby the cylinder part 10 can be prevented from withdrawing from the instrumental panel 1 backward. Then, the instrumental panel 1 is pinched, at the opening edge of the bracket port 9, between the flange part 11 and the panel-carrier projections 12A, 12B, while the engagement claws 13A, 13B, 13C enter into a gap between the instrumental panel 1 and the female connector housing 18 and lean against the inside wall of the panel 1 with elasticity. In this way, the bracket 3 is carried and secured on the mounted part 2 of the panel 1.

For the temporary engagement of the female connector 4 with the bracket 3, it is carried out to insert the leading end of the female connector 4 into the opening (on the side of the base end) of the bracket 3 until the stoppers 23 of the housing 18 butt against the stopper receivers 24 of the bracket 3. With this action, the bosses 21 on the female connector housing 18 climb over the temporary-engagement arms 14, so that their tips come into contact with the lateral faces of the bosses 21. Thus, the return of the female connector 4 can be prevented to effect the temporary engagement. Note, this operation to temporarily engage the female connector 4 with the bracket 3 may be executed before or after the operation to attach the bracket 3 to the instrumental panel 1.

Next, the constitution of the male connector 5 will be described with reference to FIG. 1 and FIGS. 11 to 19.

Figure 11:
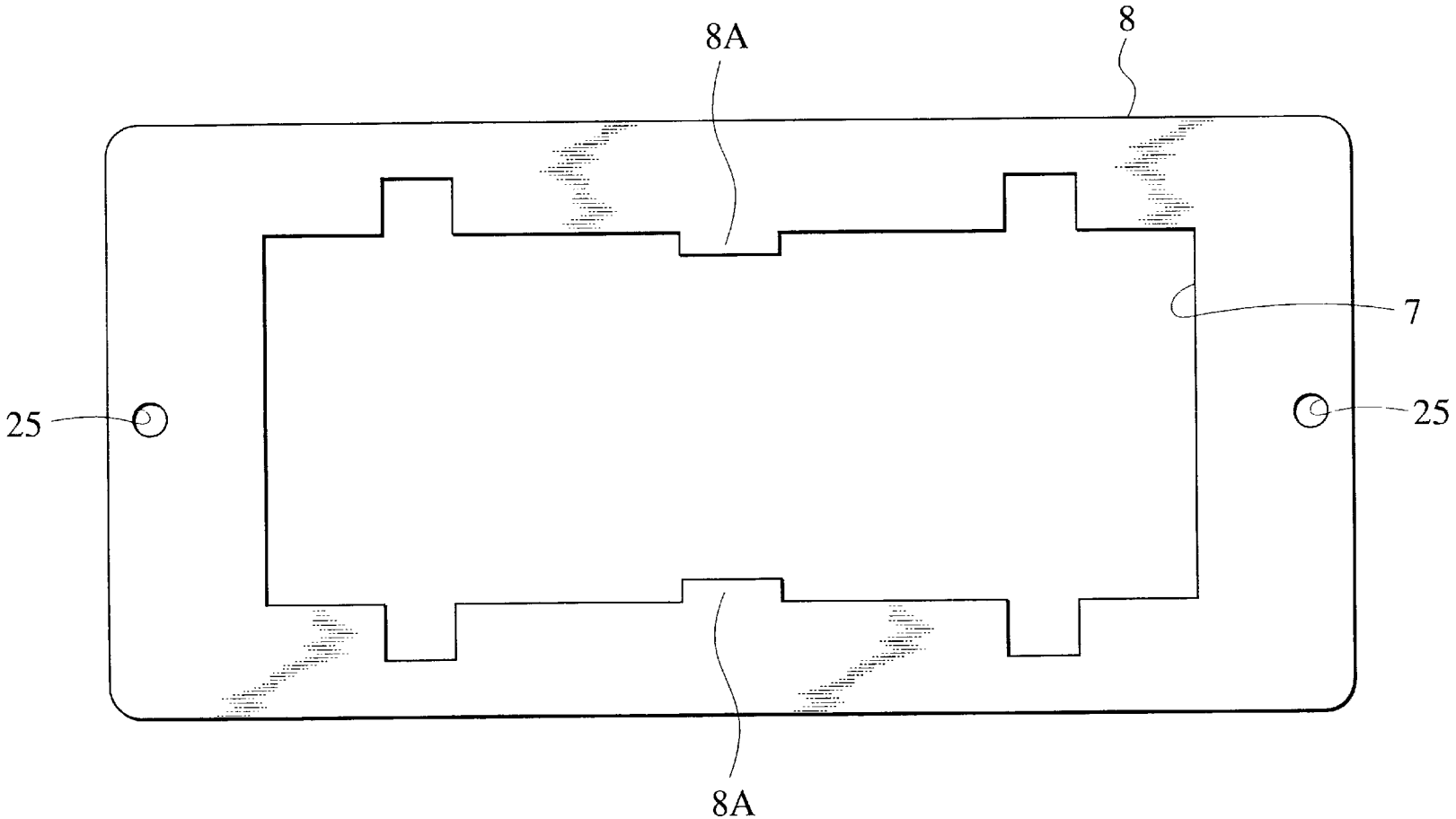
FIG. 11 is a front view of an escutcheon of the connector supporting structure of the embodiment.
Figure 12:
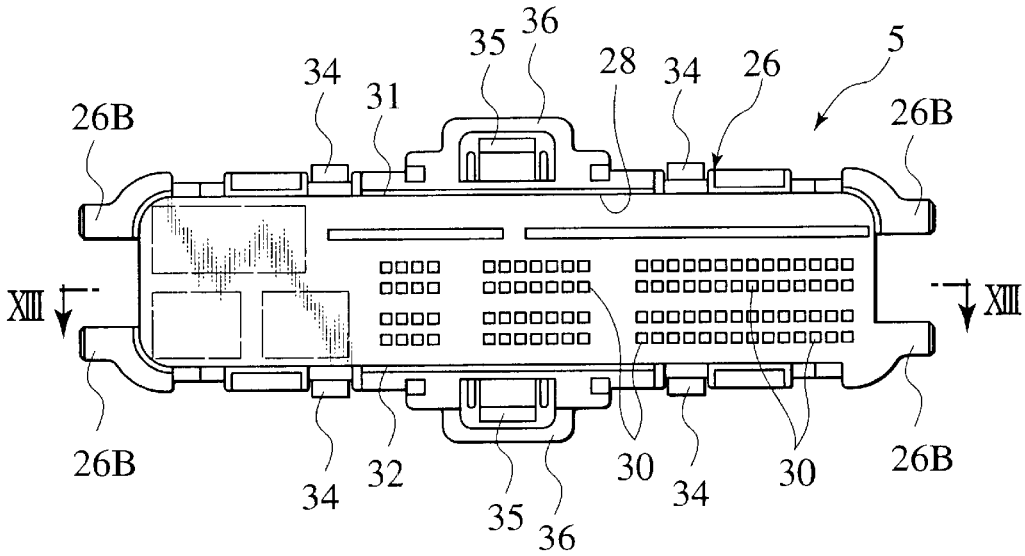
FIG. 12 is a plan view of a male connector housing forming the connector supporting structure of the embodiment of the invention.
Figure 13:
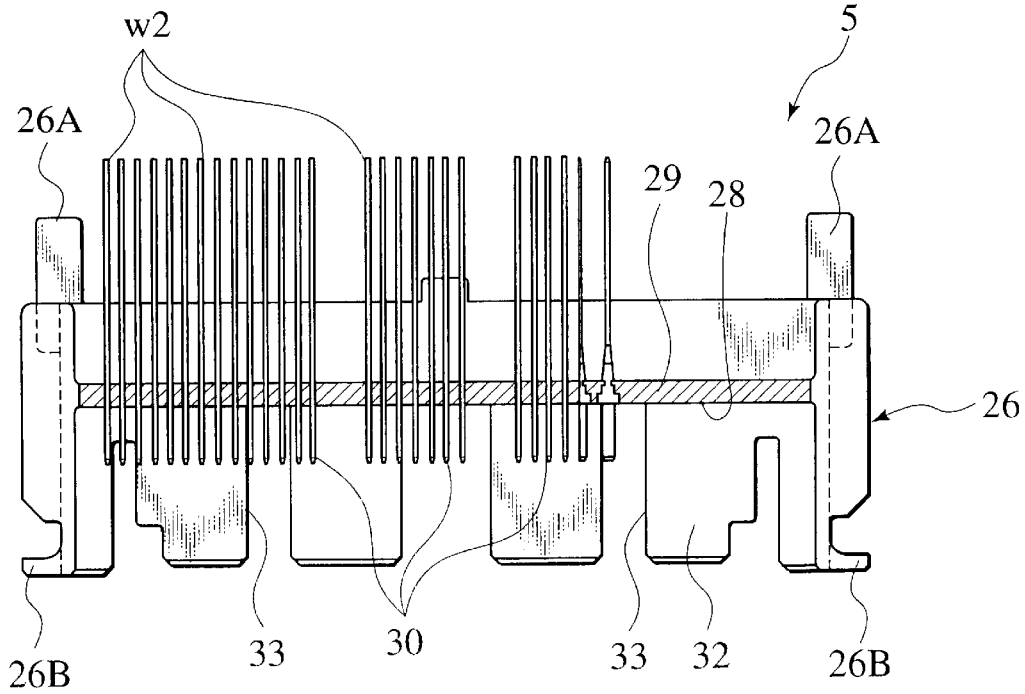
FIG. 13 is a cross-sectional view taken along line XIII—XIII of FIG. 12.
Figure 14:
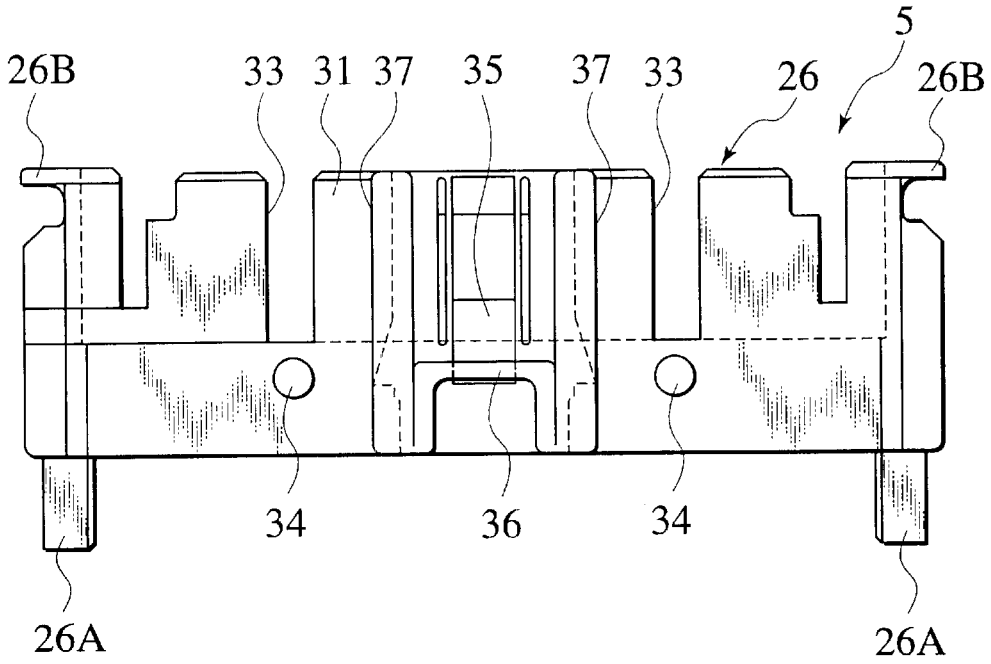
FIG. 14 is a front view of the male connector housing of the embodiment.
Figure 15:
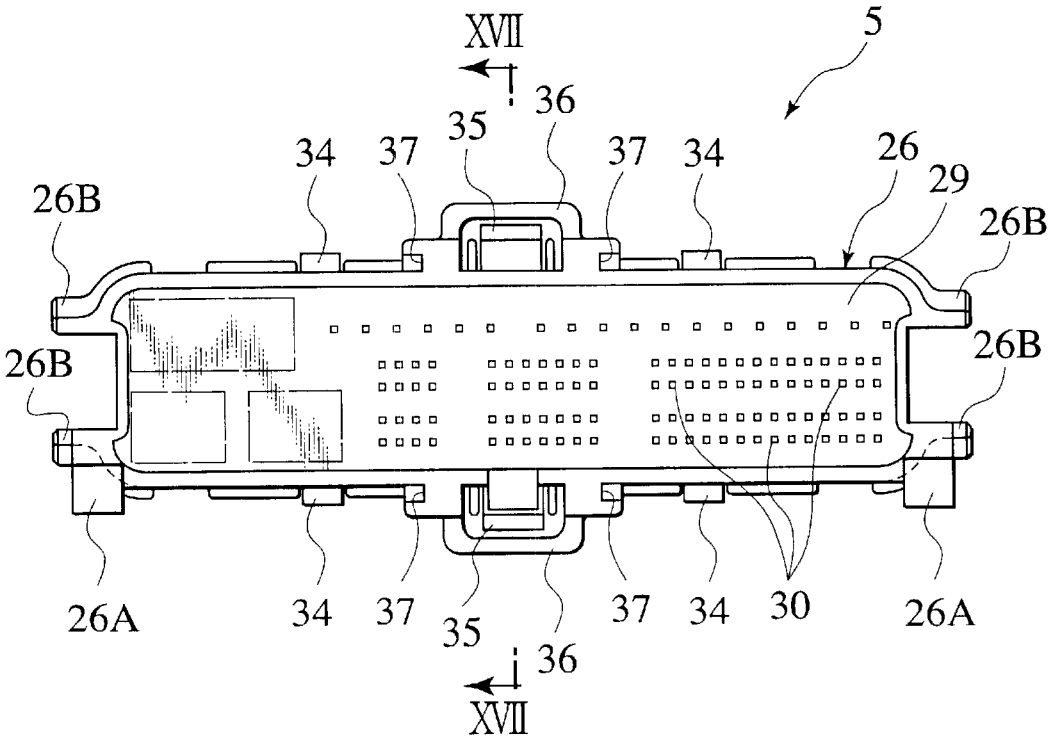
FIG. 15 is a rear view of the male connector housing of the embodiment.
Figure 16:
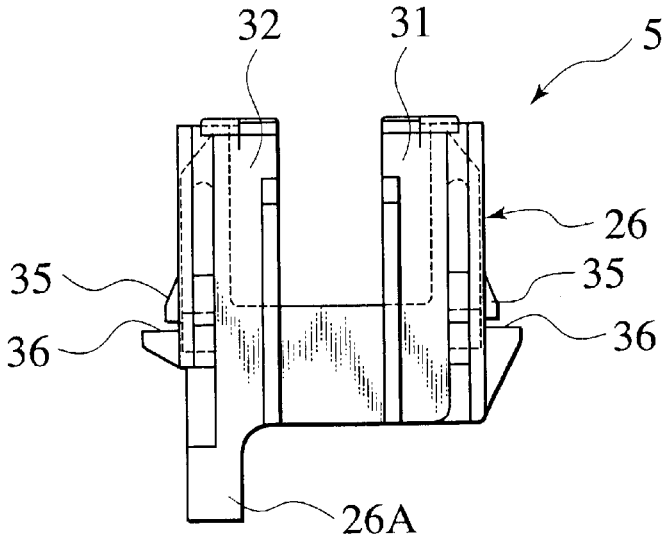
FIG. 16 is a side view of the male connector housing of the embodiment.
Figure 17:
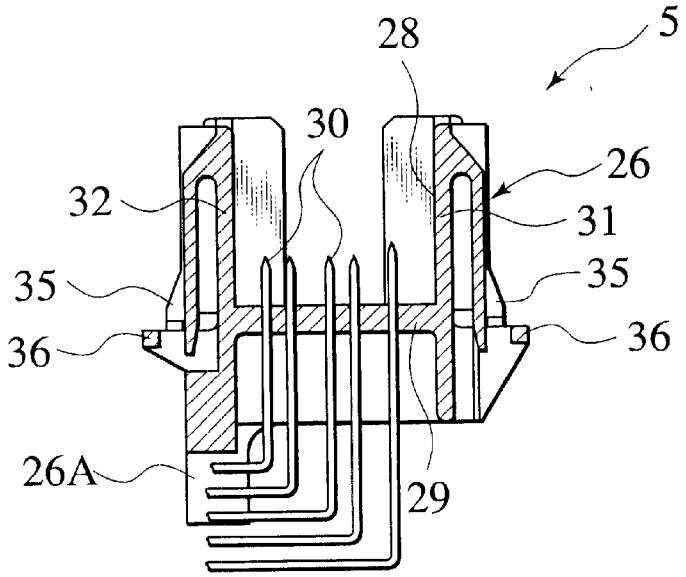
FIG. 17 is a cross-sectional view taken along line XVII—XVII of FIG. 15.
Figure 18:
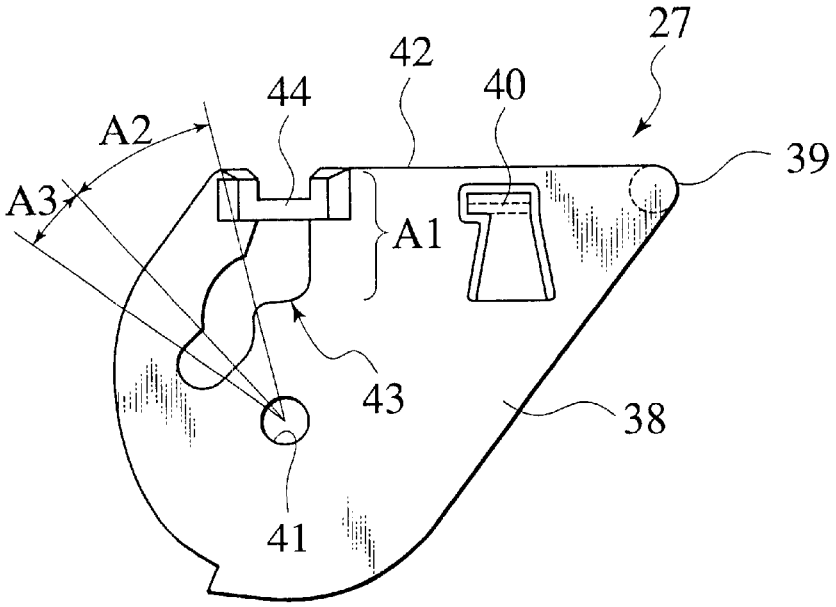
FIG. 18 is a plan view of a cam lever attached to a male connector of the embodiment.
Figure 19:
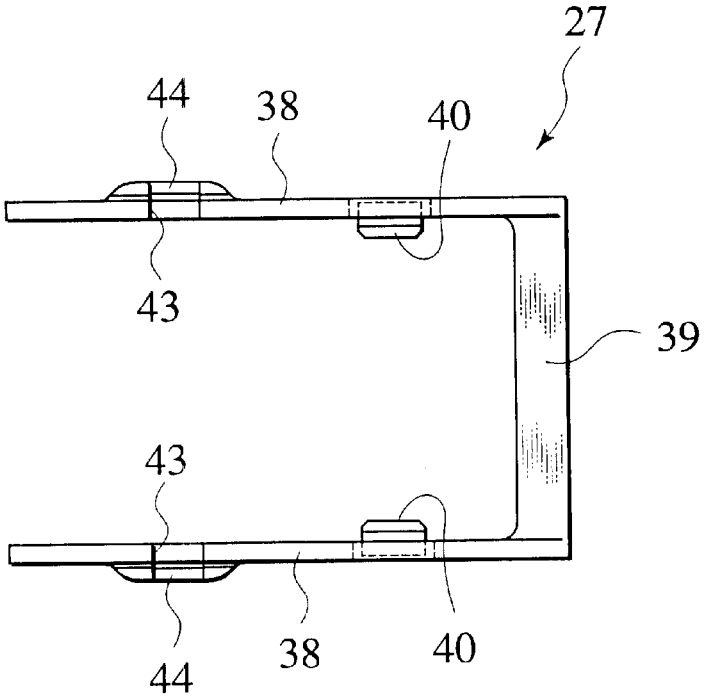
FIG. 19 is a side view of the cam lever of the embodiment.

FIG. 11 is a front view of the escutcheon; FIG. 12 a plan view of the male connector housing, viewed from the leading end; FIG. 13 a cross-sectional view taken along line XIII—XIII of FIG. 12; FIG. 14 a front view of the male connector housing; FIG. 15 is a rear view of the male connector housing; FIG. 16 a side view of the male connector housing; FIG. 17 a cross-sectional view taken along line XVII—XVII of FIG. 15; FIG. 18 a plan view of the cam lever; and FIG. 19 is a side view of the cam lever.

In FIG. 1, the male connector 5 has its fixing parts 26A fixed to the base plate 6 on the appliance's side. The escutcheon 8 is arranged so as to stand on the rear edge of the base plate 6 perpendicularly to the base plate 6. In FIG. 11, the escutcheon 8 has a connector port 7 formed to make the male connector 5 project to the outside. Formed on both sides of the port 7 of the escutcheon 8 are screw holes 25, 25 which are used to screw the instrumental panel 1 up. Further, the connector port 7 has projecting pieces 8A, 8A formed at respective centers of the upper and lower edges, for engagement with the male connector housing 26.

Roughly speaking, the male connector 5 has the male connector housing 26 and a pair of cam levers 27 rotatably carried by the male connector housing 26, as shown in FIG. 1.

As shown in FIGS. 12,13 and 17, the male connector housing 26 is provided, on a front side thereof, with a recess 28 for receiving the female connector housing 18. On a bottom plate 29 of the recess 28, a plurality of male terminals 30 are arranged so as to project toward the loading end of the male connector 30. Penetrating the bottom plate 29, the male terminals 30 have their rear ends connected with wires w2 respectively. The wires w2 are connected with not-shown wires on the base plate 6 to connect them to various circuits, electronic parts, etc. of the instruments.

The male connector housing 26 has an upper wall 31 and a lower wall 32 formed on upper and lower margins of the bottom plate 29 to extend in the front-and-rear direction (fitting direction) of the male connector 5. The upper wall 31 is parallel with the lower wall 32. On both sides of the rear end of the lower wall 32, the above fixing parts 26A extend backward.

On both sides of the front end of the male connector housing 26, as shown in FIGS. 12 to 15, two pairs of protective cover parts 26B, 26B are formed to extend outside the housing 26 in the direction of width. Positioned behind the protective cover parts 26B are rotating handling parts 39 which are respective portions of the cam levers 27 in the initial positions. Owing to the positioning of the handling parts 39 behind the protective cover parts 26B, when inserting the male connector 5 into the bracket 3, the parts 26B operate to protect the handling parts 39 to prevent them from being damaged. Note, in order to allow the male connector housing 26 to contact with the guide projecting part 17, the upper and lower protective cover parts 26B are separated from each other on one side of the front end of the male connector 5.

In FIGS. 13 and 14, Each of the upper wall 31 and the lower wall 32 has a pair of boss-guide slits 33, 33 formed to guide the bosses 21 of the female connector 4 in the fitting direction when fitting the male connector 5 to the female connector 4. Additionally, behind the slits 33 (on the rear side in the fitting direction), the upper wall 31 and the lower wall 32 have two pairs of lever-attachment shafts 34 formed to project up and down.

Between the pair of slits 33, 33 on each of the walls 31, 32, there are formed a panel engagement piece 35 which gradually rises from the front end of the male connector 5 toward the rear obliquely and a panel hooking part 36 which stands on the rear end of the piece 35. In assembly, since each of the projecting pieces 8A, 8A of the escutcheon 8 is disposed between the panel engagement piece 35 and the panel hooking part 36, the male connector housing 26 can be carried by the escutcheon 8.

Further, on each of the walls 31, 32, rotation-control parts 37 in the form of projecting banks are formed on both sides of the panel engagement piece 35 (and also the panel hooking part 36) to define the rotational terminuses of the cam levers 27.

The structure of one cam lever 27 will be described with reference to FIGS. 18 and 19.

The cam lever 27 has a pair of parallel lever plates 38, 38 each shaped to be generally triangular and the rod-shaped handling part 39 for connecting one peak of the triangular lever plate 38 to the same of the other lever plate 38.

Additionally, one lever plate 38 is provided, in the vicinity of the handling part 39, with a temporary engagement piece 40 which rises obliquely toward the opposing lever plate 38 (see FIG. 19). The temporary engagement piece 40 is provided to temporarily engage the cam lever 27 with the male connector housing 26 at the initial position.

On the opposite side of the handling part 39 about the center of each lever plate 38, a shaft hole 41 is formed to accept the lever-attachment shaft 34 projecting from the male connector housing 26.

On a plate's edge 42 beside the shaft hole 41, a cam groove 43 is formed to guide the boss 21 with the rotation of the lever plate 38. The cam groove 43 is provided, at the entrance, with a reinforcing plate 44. In view of preventing the interference with the boss 21 inserted into the cam groove 43, this reinforcing plate 44 is formed so as to stride over the cam groove 43.

The cam groove 43 has a boss-introducing area Al extending from the side edge 42 toward the shaft hole 41 generally linearly, a force-magnifying area A2 for moving the boss 21, which has been brought to the inmost part of the area A1, to the vicinity of the hole 41 forcibly owing to the magnifying action with the rotation of the lever plate 38, and a racing area A3.

The force-magnifying area A2 is formed by a groove part which is curved so as to approach the center of the shaft hole 41 gradually. The racing area A3 is formed by another groove part extending along the circumference about the center of the shaft hole 41. The groove length of the racing area A3 is established corresponding to the bending (dimension) of the mounted part 2 of the instrumental panel 1 though the length will be mentioned later in detail.

Each of the cam levers 27 constructed above is rotatably supported by the lever-attachment shafts 34, 34 projecting on the upper and lower walls 31, 32 of the male connector housing 26. At the initial positions of the cam levers 27, 27, the side edges 42 of the lever plates 38 are substantially parallel with the front edge of the front connector housing 26. In this state, the handling parts 39 are respectively positioned behind the protective cover parts 26B formed on the male connector housing 26. The respective cam levers 27 are adapted so that the handling parts 39 rotate toward the rear end of the male connector housing 26 when the female and male connectors 4, 5 are fitted to each other. That is, both of the cam levers 27 are adapted so as to rotate in the opposite directions mutually.

Next, with reference to FIGS. 20 to 30, we describe a method of assembling the female connector 4 to the male connector 5 in the connector supporting structure and also its operation.

Figure 20:
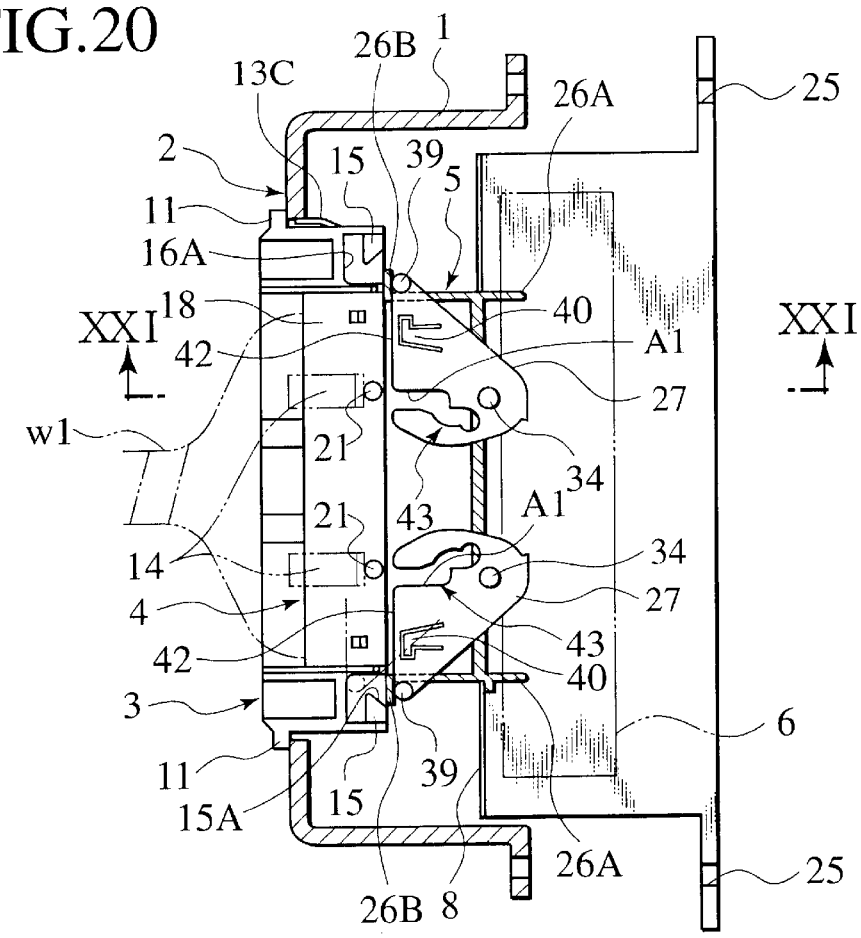
FIG. 20 is an explanatory partial-sectional view showing a condition directly before fitting the male connector to a female connector of the embodiment.
Figure 21:
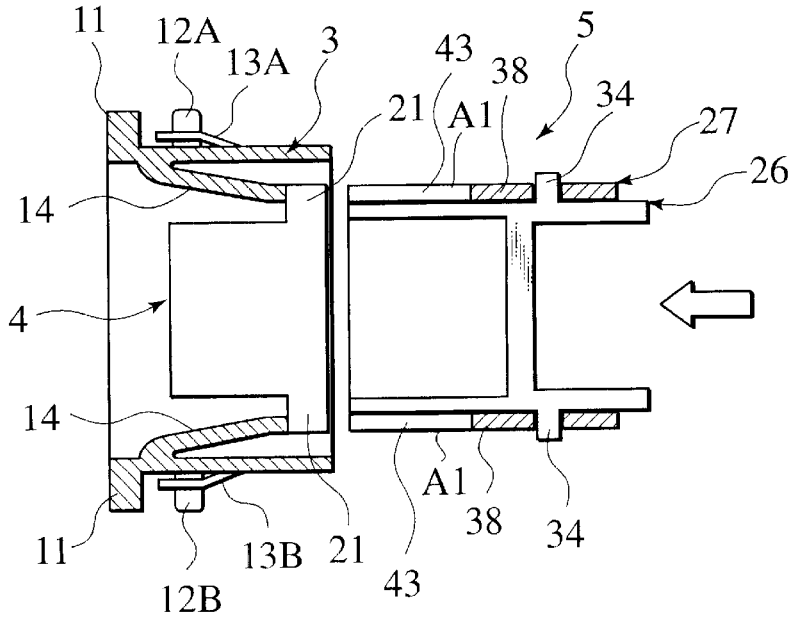
FIG. 21 is an explanatory sectional view taken along line XXI—XXI of FIG. 20.

First, attach the bracket 3 to the bracket port 9 formed in the mounted part 2 of the instrumental panel 1 by using the above-mentioned technique. In this stage, the female connector housing 4 is already engaged with the bracket 3 temporarily. That is, by inserting the leading end of the female connector 4 into the bracket 3 through its opening on the side of the base end, it is carried out to fit the connector 4 to the bracket 3 until the stoppers 23 of the female connector housing 18 butt against the stopper receivers 24 of the bracket 3. Consequently, as shown in FIGS. 20 and 21, there is realized a condition that the bosses 21 of the female connector housing 18 surmount the temporary engagement arms 14 so that their tips butt against the side faces of the bosses 21, effecting the temporary engagement of the female connector 4. Note, the operation to engage female connector 4 with the bracket 3 temporarily may be performed before or after the operation to attach the bracket 3 to the instrumental panel 1.

Next, we describe the operation to fit the female connector 4, which has been temporarily engaged in the instrumental panel 1 through the bracket 3, to the male connector 5.

As shown in FIG. 20, bring the male connector 5 and the female connector 4 into a close relationship while the leading face of the male connector 5 on the appliance's side is facing on the leading face of the female connector 4 temporarily engaged in the bracket 3. Then, the cam levers 27 occupy their initial positions. In detail, the side edges 42 of the lever plates 38 respectively become parallel with the front edge of the male connector 5, so that the rotating handling parts 39 are on the backside of the protective cover parts 26B. While, the temporary engagement pieces 40 are temporarily engaged with the male connector housing 26 to maintain the initial positions of the cam levers 27. In this initial state, when the male connector 5 butts against the female connector 4, each boss 21 on the female connector housing 18 is inserted into the inlet of the boss-introducing area A1 of the cam groove 43. FIG. 21 is a sectional view taken along line XXI—XXI of FIG. 20, showing both of one condition where the bracket 3 temporarily engages with the female connector 4 through the arms 14 and another condition where the boss-introducing areas A1 are about to collect the bosses 21.

Figure 22:
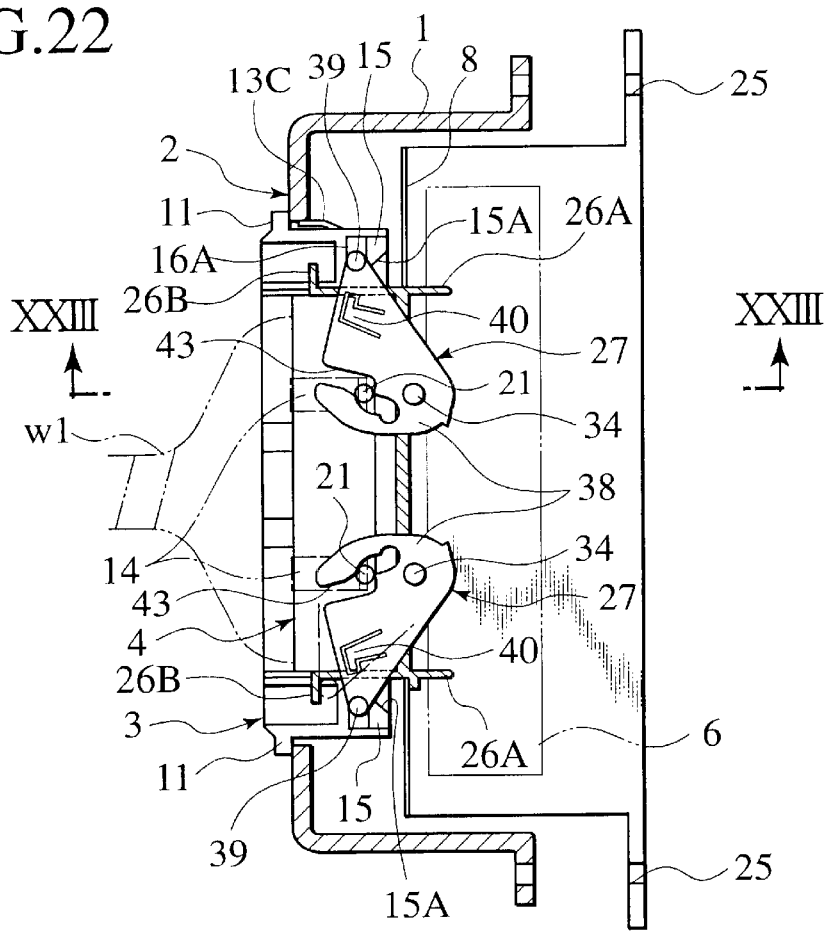
FIG. 22 is an explanatory partial-sectional view showing a condition where a boss is positioned at the end of a boss-introducing area of a cam groove since the male connector has been fitted to the female connector.
Figure 23:
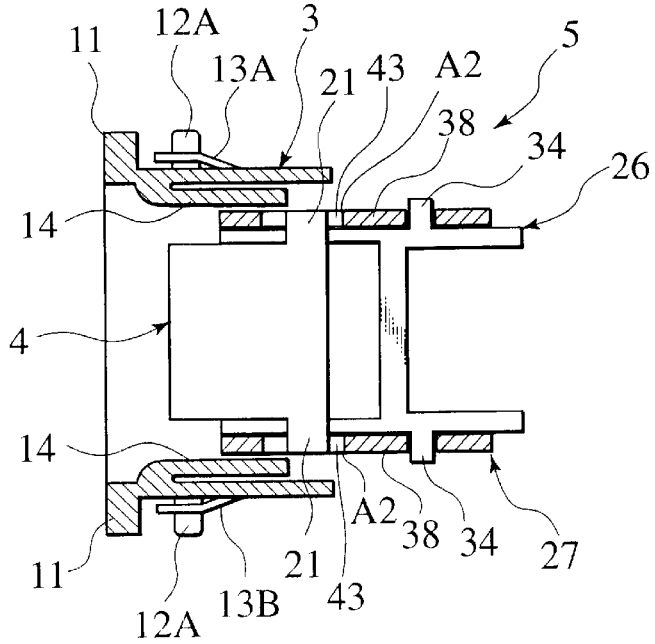
FIG. 23 is an explanatory sectional view taken along line XXIII—XXIII of FIG. 22

Next, as shown in FIGS. 22 and 23, further push the male connector 5 into the female connector 4 in the fitting direction. Consequently, the protective cover parts 26B in front of the handling parts 39 are respectively guided by the slanted faces 15A of the projections 15 and brought into the positions beyond the step parts 16A. At this time, the rotating handling parts 39 lean on the step parts 16A, while the protective cover parts 26B do not interfere with the parts 16A. When the male connector 5 is pushed furthermore, then each rotating handling part 39 moves outward along the face of the step part 16A and finally enters into the space on the back side of the projection 15. Simultaneously, each cam lever 27 is subjected to reaction force to urge the rotating handling part 39 backward of the male connector housing 26, through a contact between the part 39 and the step part 16A. The reaction force is converted to a force to rotate the cam lever 27 about the attachment shaft 34 as a fulcrum for rotation.

As a result, the lever plates 38 of each cam lever 27 begin their rotation to release the temporary engagement between the temporary engagement pieces 40 and the male connector housing 26. Additionally, with the rotation of the cam levers 27, each lever plate 38 also operates to separate the temporary engagement arm 14 of the bracket 3, which has temporarily engaged with the female connector housing 18 behind the boss 21, from the female connector housing 18 outwardly. Consequently, the temporary engagement between the female connector 4 and the bracket 3 is released to establish a condition where the connector 4 is carried by the male connector 5 only through the cam levers 27. In this way, since the female connector housing 4 is free from the bracket 3 and also the instrumental panel 1, the moving distance of the male connector 5 in the fitting direction is not restricted by the female connector 4. Therefore, it is possible to gain both rotating stroke and rotating angle of the cam levers 27 sufficiently and also possible to increase the force-magnifying effect mentioned later.

Figure 24:
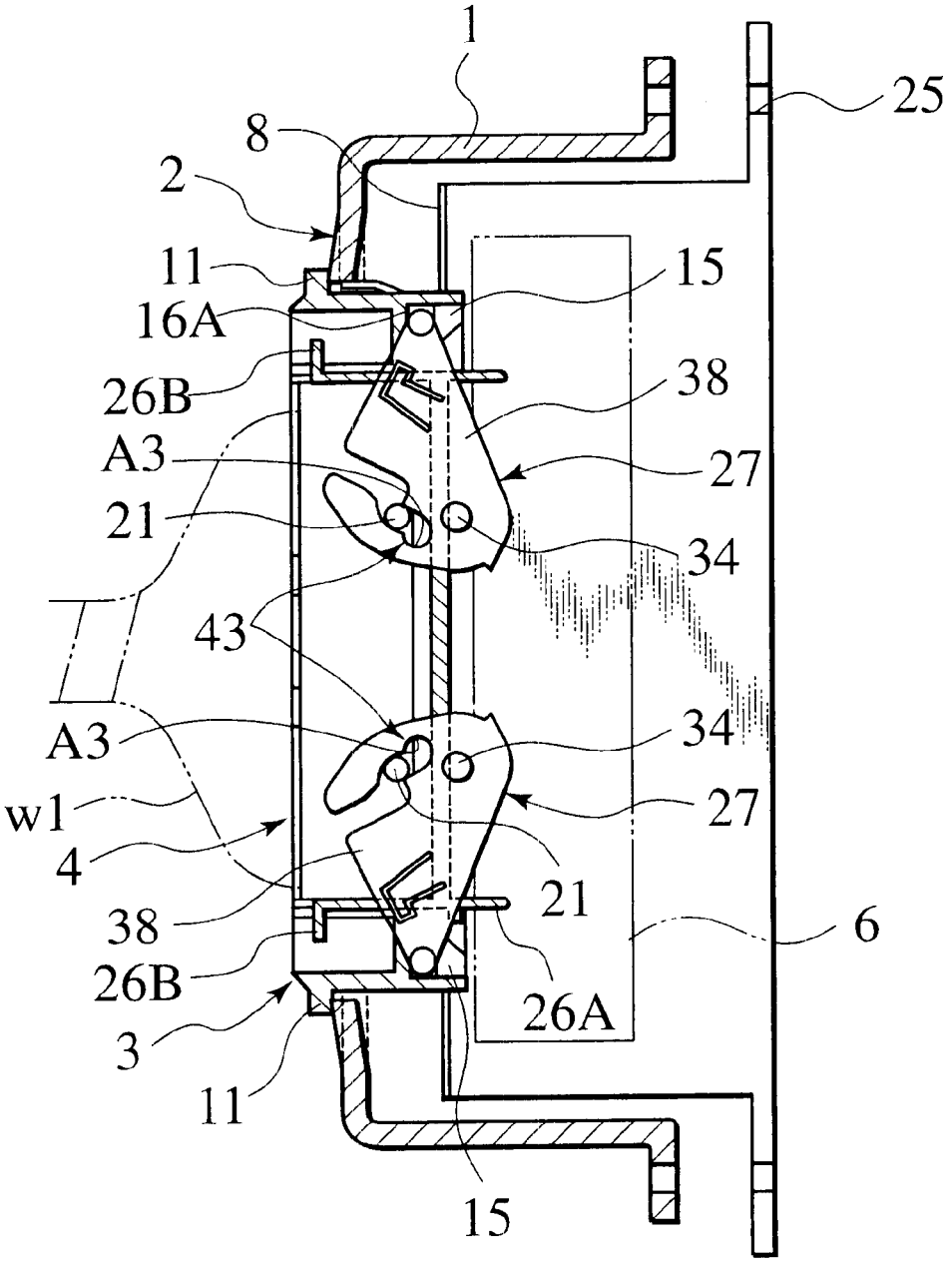
FIG. 24 is an explanatory partial-sectional view showing a condition where the boss is positioned in a force-magnifying area of the cam groove since the male connector has been fitted to the female connector.

In other words, despite that the arm of rotational moment of the reaction force applied on the rotating handling part 39 is extremely long in comparison with a distance between the force-magnifying area A2 and the attachment shaft 34, it is possible to amplify the force-magnifying effect in the force-magnifying area A2 owing to the enlarged rotating stroke and rotating angle. The force-magnifying area A2 operates to let the boss 21 forcibly come near the shaft 34 by the force-magnifying effect since the area A2 is provided with its contours gradually approaching the shaft 34. Thus, even if the force to press the male connector 5 is small, it is possible to let the boss 21 come near the shaft 34 certainly, developing the engagement between the male connector 5 and the female connector 4 furthermore. FIGS. 22 and 23 show a condition where the bosses 21 are respectively positioned in the force-magnifying areas A2. Note, FIG. 23 is a sectional view taken along line XXIII—XXIII of FIG. 22. FIG. 24 shows a condition where the bosses 21 are moving from the force-magnifying areas A2 toward the racing areas A3. In this condition, since each rotating handling part 39 thrusts the step part 16A of the bracket 3 corresponding to the pressing of the male connector 5, the instrumental panel 1 is slightly deformed backward in the vicinity of the mounted part 2.

Figure 25:
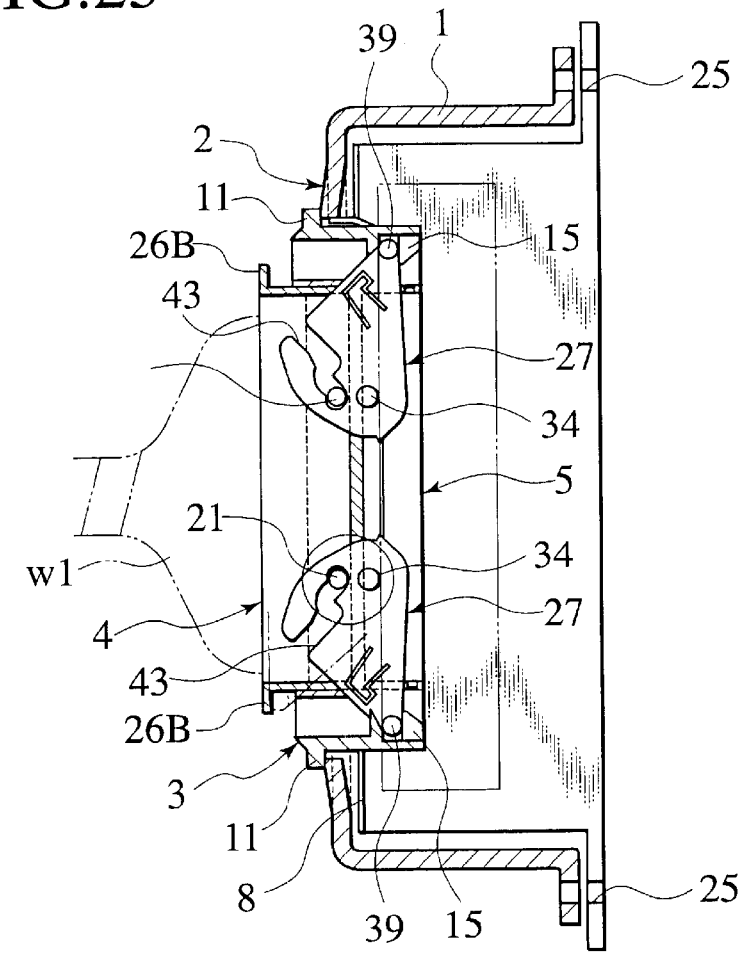
FIG. 25 is an explanatory partial-sectional view showing a condition where the boss is positioned at the end of the force-magnifying area of the cam groove since the male connector has been fitted to the female connector.
Figure 26:
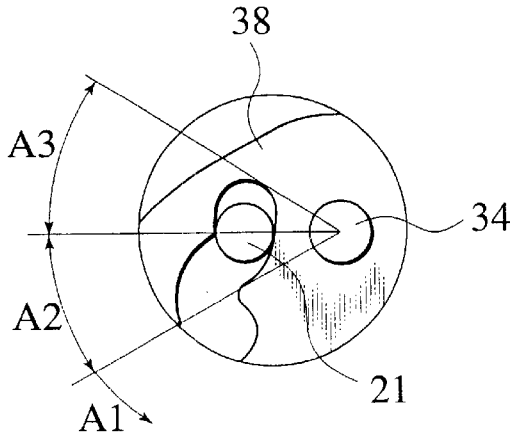
FIG. 26 is an enlarged view of a part enclosed by a circle of FIG. 25.

By further pushing the male connector 5 into the female connector 4, the former is perfectly fitted in the latter to complete the engagement therebetween, as shown in FIG. 25. Then, each boss 21 on the female connector housing 18 is positioned at the inlet of the racing area A3 upon passing through the terminus of the area A2, as shown in FIG. 26. FIG. 26 is an enlarged view of a circle of FIG. 25. Also in this state, the instrumental panel 1 in the vicinity of the mounted part 2 is still deformed backward, as similar to the condition of FIG. 24.

Figure 27:
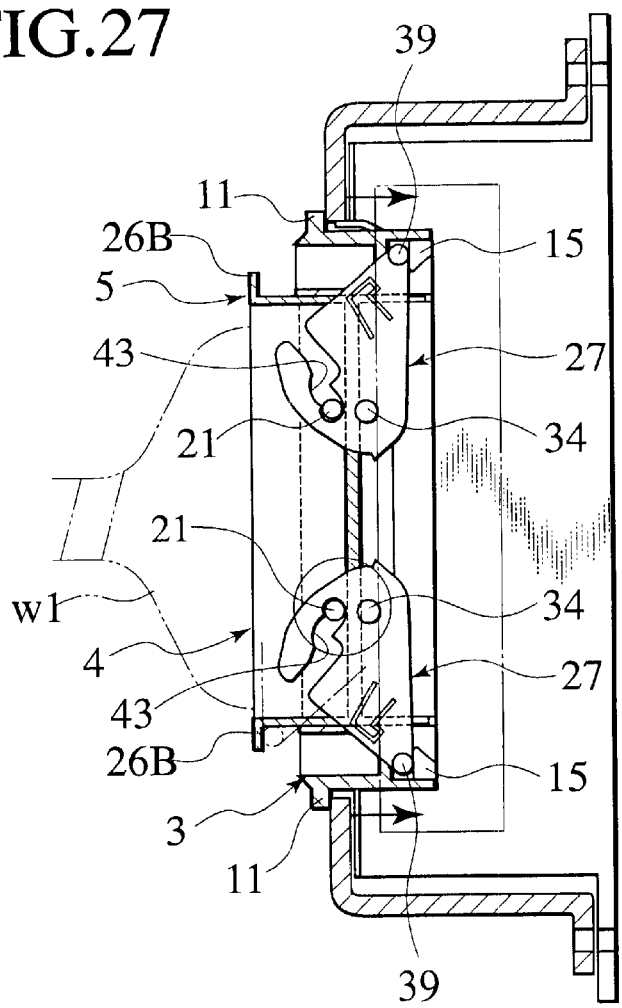
FIG. 27 is an explanatory partial-sectional view showing a condition where the boss is moving in a racing area of the cam groove since the male connector has been fitted to the female connector.
Figure 28:
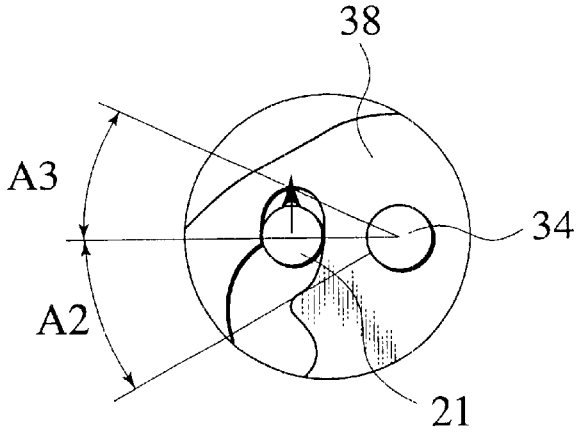
FIG. 28 is an enlarged view of a part enclosed by a circle of FIG. 27.

Subsequently, when the above bending of the instrumental panel 1 is canceled due to its elasticity instantaneously, the rotating handling part 39 of each cam lever 27 is further rotated backward, as shown in FIG. 27. Then, the male connector 5 does not change its position. In this state, the cam levers 27 (the lever plates 38) rotate within a range of the racing areas A3, while the bosses 21 only move in the racing areas A3 relatively without being affected by the cam levers 27. That is, since each of the racing areas A3 is shaped along the circumference of a circle about the attachment shaft 34 (the hole 41), the bosses 21 are not influenced by the rotation of the cam levers 27. In this way, the recovery of the bending instrumental panel 1 is absorbed by the relative movement of the bosses 21 in the racing areas A3, exerting no influence on the engagement between the male connector 5 and the female connector 4. Note, FIG. 28 is an enlarged view of a circle of FIG. 27.

Figure 29:
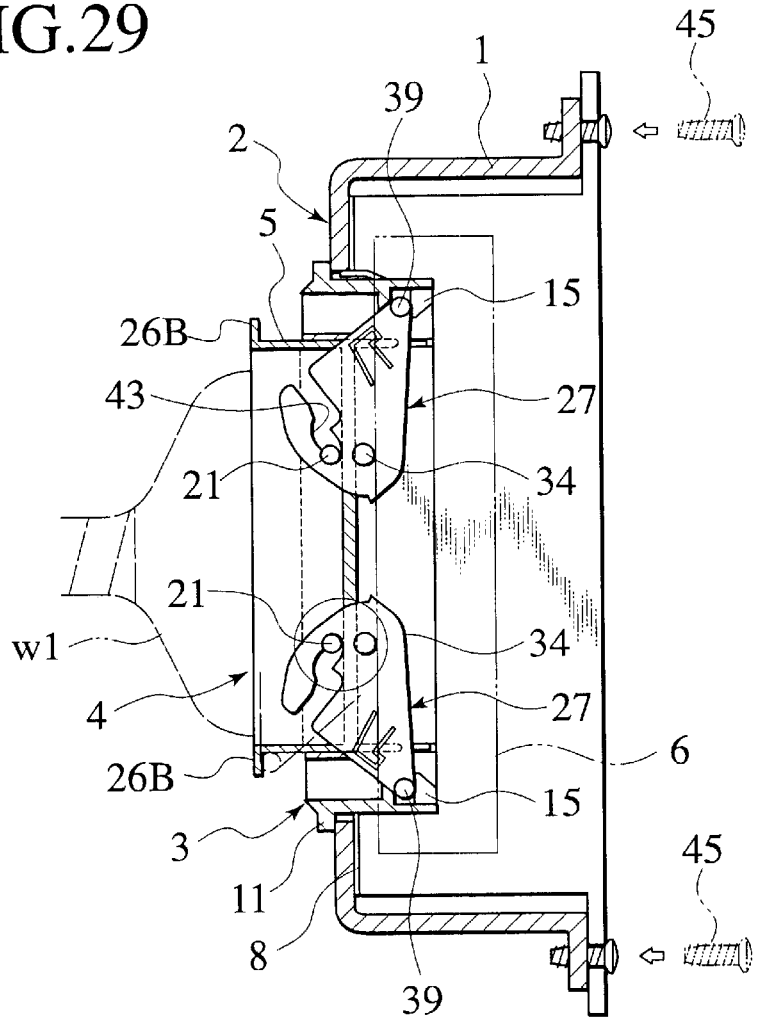
FIG. 29 is an explanatory partial-sectional view showing a condition where the bending of an instrumental panel is absorbed by the movement of the boss in the racing area of the cam groove since the male connector has been perfectly fitted to the female connector.
Figure 30:
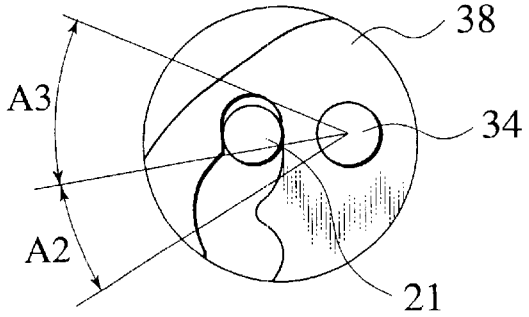
FIG. 30 is an enlarged view of a part enclosed by a circle of FIG. 29.

FIGS. 29 and 30 show a condition where the female connector 4 is completely connected with the male connector 5 while the instrumental panel 1 is withdrawn from bending. FIG. 30 is an enlarged view of a circle of FIG. 29. Then, each boss 21 is positioned in the racing are A3 so that the engagement between the female and male connectors 4, 5 is not affected by the slight shaking of the cam levers 27. Finally, as shown in FIG. 29, the instrument 1 is fixed with the appliance by means of screws 45, thereby completing the assembling operation of the connector supporting structure of the embodiment.

We describe a method of releasing the so-accomplished connection between the connectors 4, 5.

First, unscrew the screws 45 and perform an operation to pull back the appliance equipped with the male connector 5 in the opposite direction to the above-mentioned fitting operation. Consequently, the male and female connectors 5, 4 begin to move toward the appliance. Then, since the rotating handling parts 39 of the cam levers 27 butt against the "seceding-force" applying faces 15B (see FIG. 5) on the back side of the projections 15, the above-retreat of the male connector 5 causes the cam levers 27 to be rotated about the attachment shafts 34 in the opposite direction to the fitting direction. With the rotation of the cam levers 27, each of the bosses 21 in the racing area A3 moves into the force-magnifying area A2.

When moving the male connector 5 back furthermore, each boss 21 in the area A2 starts to move toward the area Al. During this movement, the boss 21 is subjected to the force-magnifying effect in the force-magnifying area A2 in the situation where the contact between the rotating handling part 39 and the face 15B operates as the point of force while the lever-attachment shaft 34 operates as the fulcrum. Consequently, by moving the male connector 5 back with a slight force, it is possible to release the engagement between the male and female connectors 5, 4 forcibly.

At the same time of disengagement of the female connector 4 from the male connector 5, the temporary-engagement arms 14, which have been deformed in the release positions by the lever plates 38, are released from the lever plates 38 to carry the female connector housing 18 again (see FIG. 23).

When the position of each boss 21 is shifted from the area A2 to the area A1 with the retreat of the male connector 5, the generally-straight shape of the area A1 allows the boss 21 to move outside the cam groove 43 with ease. Note, during this movement, a force required to move the male connector 5 back is remarkably small due to the shallow engagement between the connectors 4, 5. It is noted that when the engagement of the connectors 4, 5 is released, the rotating handling parts 39 of the cam levers 27 are free to rotate toward the front end of the male connector 5. Therefore, the rotating handling parts 39, 39 of both cam levers 27 can approach each other thereby to allow each part 39 to be withdrawn from a gap between the projection 15 and the male connector housing 26. In this way, the female connector 4 can be separated from the male connector 5 perfectly. Even in this state, there is no possibility that the female connector 4 falls from the instrumental panel 1 due to the temporarily engagement by the bracket 3.

According to the connector supporting structure of the embodiment, the temporary engagement of the female connector housing in the bracket is canceled when the male connector begins to be fitted to the female connector. Therefore, it is possible to lengthen the stroke of the male connector 5 in the fitting direction. Then, since the rotating handling parts 39 of the cam levers 27 are fixed by the step parts 16A of the projections 16, it is possible to increase the rotating angle of the cam levers 27 by the long stroke of the male connector 5 in the fitting direction. In this way, owing to the increased rotating angle of the cam levers 27, each of the force-magnifying areas A2 is shaped so as not to abruptly approach the attachment shaft 34 (the hole 41) but gradually, in other word, drawing a gentle arc, whereby it is possible to reduce a force to push the male connector 5 (fitting load). According to the embodiment, the female and male connectors 4, 5 can be easily joined to each other by only the operator's adjusting their front ends in position.

As mentioned before, since the female connector 4 is not supported by the instrumental panel 1 in the fitting condition of the female and male connectors 4, 5, (releasing of the temporary engagement), it is possible to restrict the vibration of the instrumental panel 1 from being transmitted to female connector 4. Thus, it is possible to reduce the influence of relative vibrations, which are derived from the difference in weight between the instrumental panel 1 and the appliance (on the male connector's side), on the connecting part between the connectors, providing the advantageous electrical connection without noise, failures in connection, etc.

Additionally, since the above-mentioned temporary engagement is accomplished by making use of the bosses 21 formed on the female connector housing 18, there is no need to provide the housing 18 with an exclusive element for the temporary engagement, whereby the structure of the housing 18 can be simplified.

According to the embodiment, the bracket 3 for temporary engagement with the female connector 4 has the projections 15 formed with the slant faces 15A for picking up the protective cover parts 26B of the male connector housing 26 and also positioning the front end of the female connector 5 appropriately. Therefore, the proper relationship in position between the connectors 4, 5 can be accomplished by the operator's simple pressing the male connector 5 on the front end of the bracket 3, easily and certainly. Repeatedly, the protective cover parts 26B operate to protect the rotating handling parts 39 on the stage before fitting the connectors 4, 5 to each other. Therefore, it is possible to prevent the parts 39 from being damaged by obstacles etc.

According to the embodiment, the so-attained engagement between the female connector 4 and the female connector 5 can be canceled by applying a slight force on the engagement with ease. In detail, when drawing the male connector 5 out, the operator's force exerted on the connector 5 is applied on the rotating handling parts 39 since they have been engaged with the "seceding-force" applying faces 15B of the projections 15. Therefore, the cam levers 27 rotate about the attachment shafts 34 as pivots. Then, since the contacts between the respective inside walls forming the force-magnifying areas A2 and the bosses 21 operates as working points, the bosses 21 are moved in the direction apart from the male connector 5 forcibly, being subjected to the force-magnifying effect. It is noted that, in each cam lever 27, the distance between the attachment shaft 34 as the pivot (fulcrum) and the rotating handling part 39 is remarkably long in comparison with the distance between the shaft 34 and the area A2. Consequently, upon the force-magnifying effect due to such a difference in length between the arms of moment of rotation, the bosses 21 are driven in the direction apart from the male connector 5.

In addition, according to the embodiment, the bending of the instrument panel 1 accompanied with the fitting operation of the male connector 5 is absorbed by the racing areas A3 in the cam levers 27, it is possible to avoid the application of unnecessary load on the connectors. Accordingly, the connector supporting structure can be realized in line with the actual assembling situation, with high reliability.

According to the present invention, since the rotating handling part is protected from its outside by the protective covering part, it is possible to prevent the rotating handling part from being damaged by obstacles etc. Thus, it is possible to prevent the cam lever from being broken, also preventing the inappropriate engagement between the first connector and the second connector.

It will be understood by those skilled in the art that the foregoing descriptions are nothing but one embodiment of the disclosed connector supporting structure. Besides this embodiment, various changes and modifications may be made to the present invention without departing from the spirit and scope of the invention.

For example, although the female connector 3 is temporarily engaged in the bracket 3 while arranging the male connector 5 on the appliance's side in the above-mentioned embodiment, the male connector 5 may be temporarily engaged in the bracket 3 while arranging the female connector 3 on the appliance's side in the modification. In such a case, the female connector 4 has to be equipped with cam levers.

In the above embodiment, the male connector 5 is fixed on the base plate 6 on the appliance's side. In connection, the connector supporting structure may be constructed by first connecting the male connector 5 with the appliance through a wire harness; second connecting only the male connector 5 with the female connector 5 and subsequently fixing the appliance on the instrumental panel 1.

Additionally, although the male connector 5 has two cam levers 27 rotatably attached to the male connector housing 26 in the shown embodiment, the male connector 5 may be provided with a single cam lever in the modification. Similarly, the female connector 4 may be provided with a single boss for engagement with the cam lever. Then, the structures of the male connector 5 and the female connector 4 can be further simplified to save the manufacturing cost.

In connection, although each cam lever 27 has a pair of lever plates 38 each having one cam groove 43 in the shown embodiment, the cam lever 27 may include a single lever plate provided with a single cam groove in the modification.

What is claimed is:

1. A connector supporting structure comprising:

an attachment member;

a first connector to be temporarily engaged with the attachment member, the first connector having a first connector housing on which at least one guide projection is formed; and a second connector for engagement with the first connector, the second connector having a second connector housing; and at least one cam lever rotatably supported on the second connector housing, the cam lever having a cam groove formed therein to guide the guide projection of the first connector and a rotating handling part formed for abutment against the attachment member; wherein the second connector housing has at least one protective cover part formed on one side of a front end of the second connector housing, the front end facing the first connector in arrangement; and the cam lever is supported on the second connector housing in a manner that the rotating handling part occupies its position behind the protective covering part when the cam lever is arranged in its initial position against the second connector housing in advance of the engagement of the second connector with the first connector;

whereby the approach of the second connector toward the first connector allows the rotating handling part of the cam lever to abut against the attachment member and also causes the cam lever to be rotated thereby to engage the first connector with the second connector.

2. A connector supporting structure as claimed in claim 1, wherein the attachment member comprises a cylindrical bracket which is fixed on an opening of a plate member to have a cylindrical port communicating with the opening of the plate member, the bracket being adapted so as to have the first connector temporarily engaged therein and also having a guide part formed on an inner face of the bracket to guide the protective cover part to an innermost part of the bracket.

3. A connector supporting structure as claimed in claim 2, wherein the bracket has an engagement step part formed behind the guide part in a direction to engage the first connector with the second connector, for engagement with the rotating handling part.

4. A connector supporting structure as claimed in claim 3, wherein the guide part is in the form of a projection having a slant face inclined to the direction to engage the first connector with the second connector.

5. A connector supporting structure as claimed in claim 4, wherein the cam lever is provided, in the vicinity of the rotating handling part, with a lever temporary-engagement piece which is engaged with the second connector housing, for temporarily engaging the cam lever in the initial position.

6. A connector supporting structure as claimed in claim 5, wherein the cam groove has at least one part formed so as to gradually approach a rotational center of the cam lever.

7. A connector supporting structure as claimed in claim 6, wherein a distance between the part of the cam groove and the rotational center is smaller than a distance between the rotating handling part and the rotational center of the cam lever.

8. A connector supporting structure as claimed in claim 3, wherein the bracket has a temporary engagement piece formed for engagement with the guide projection of the first connector thereby to effect the temporarily engagement of the bracket with the first connector.

9. A connector supporting structure as claimed in claim 8, wherein the temporarily engagement of the bracket with the first connector is released by the cam lever on the second connector when the second connector is engaged with the first connector.

* * * * *